US008454226B2

(12) United States Patent
Oostwegel

(10) Patent No.: US 8,454,226 B2
(45) Date of Patent: Jun. 4, 2013

(54) WATCH COMPRISING AN OUTER FRAME AND AN INNER FRAME COMPRISING A CLOCKWORK

(76) Inventor: Rolandus Jacobus Josef Maria Oostwegel, Heerlen (NL)

( * ) Notice: Subject to any disclaimer, the term of this patent is extended or adjusted under 35 U.S.C. 154(b) by 175 days.

(21) Appl. No.: 13/057,802

(22) PCT Filed: Jul. 24, 2009

(86) PCT No.: PCT/NL2009/000154

§ 371 (c)(1),
(2), (4) Date: Mar. 15, 2011

(87) PCT Pub. No.: WO2010/019028

PCT Pub. Date: Feb. 18, 2010

(65) Prior Publication Data

US 2011/0182153 A1 Jul. 28, 2011

(30) Foreign Application Priority Data

Aug. 11, 2008 (NL) ..... 1035810

(51) Int. Cl.
*G04B 37/00* (2006.01)

(52) U.S. Cl.
USPC ..... 368/276

(58) Field of Classification Search
USPC ..... 368/276, 141, 286, 287, 299, 300, 368/326
See application file for complete search history.

(56) References Cited

U.S. PATENT DOCUMENTS

| | | | | |
|---|---|---|---|---|
| 4,204,396 | A * | 5/1980 | Breguet | 368/287 |
| 7,431,495 | B2 * | 10/2008 | Cretin et al. | 368/287 |
| 2011/0019508 | A1 * | 1/2011 | Behling et al. | 368/287 |

FOREIGN PATENT DOCUMENTS

| | | |
|---|---|---|
| CN | 298200 | 7/1954 |
| FR | 1512017 | 2/1968 |

* cited by examiner

*Primary Examiner* — Edwin A. Leon
(74) *Attorney, Agent, or Firm* — Rankin Hill & Clark LLP

(57) ABSTRACT

A watch includes an outer frame and an inner frame having a clockwork. The frames are connected by at least two substantially radially extending, spaced-apart elastic elements. The elastic elements absorb forces that act on the outer frame. The outer frame is provided with at least two openings, in each of which openings an elastic element can be positioned from outside. The opening and the elastic element are configured to effect a detachable connection therebetween.

7 Claims, 2 Drawing Sheets

WATCH COMPRISING AN OUTER FRAME AND AN INNER FRAME COMPRISING A CLOCKWORK

Figure 1A:
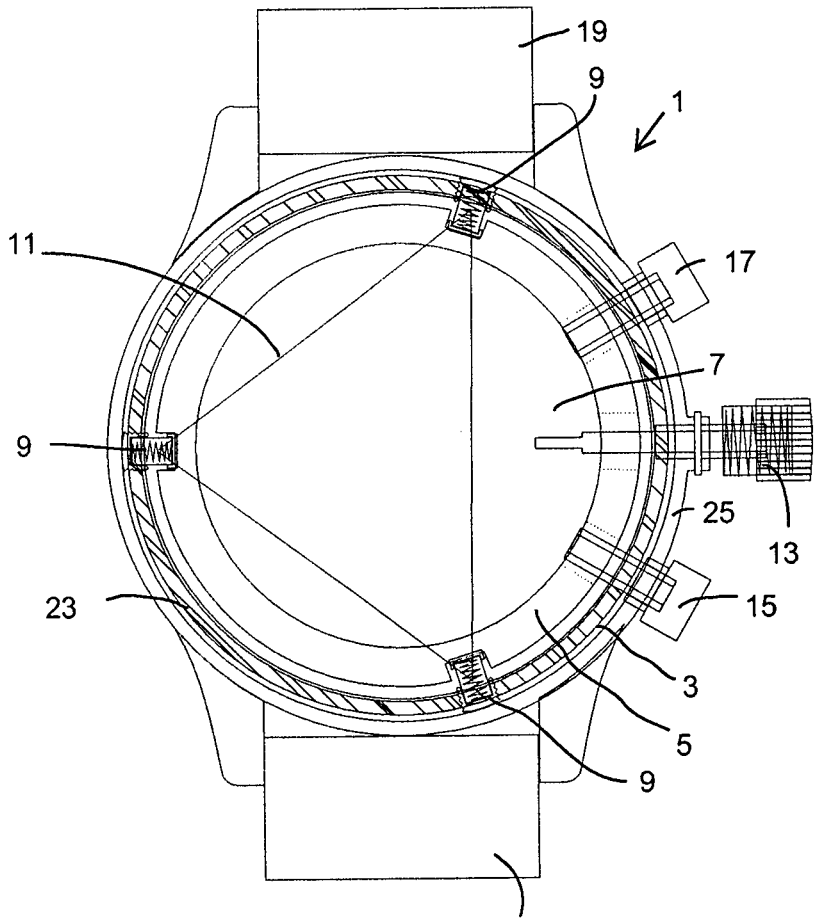

The invention relates to a watch comprising an outer frame and an inner frame comprising a clockwork, which frames are connected by at least two substantially radially extending, spaced-apart elastic elements, which elastic elements absorb forces that act on the outer frame.

FR-1,512,017 describes such a watch. The inner frame thereof is formed by an inner ring, which is indicated at 7 in the figures, to which inner frame a clockwork is fixed. The outer frame is indicated at 2 in the figures. The inner ring is connected to an outer ring by means of a number of substantially radially extending elastic elements. The outer ring is connected to the outer frame and is indicated at 6. In combination with the elastic elements, the inner ring and the outer ring form a shock-absorbing element. The elastic elements, for example the rubber elements described in said French patent document, are essential in preventing damage to the clockwork, which is sensitive to shocks. An incorrectly mounted element and/or a worn element can lead to major damage to the clockwork, since such an incorrectly mounted and/or worn element is not (sufficiently) capable of absorbing the forces that are exerted on the outer frame.

A drawback of the above-described watch is that the elastic elements are not easy to get at and difficult to fit. Replacing and/or inspecting the elastic elements during maintenance is thus a relatively difficult operation.

Accordingly it is an object of the present invention to provide a watch which is easier to fit and to inspect.

This object is accomplished with the watch according to the invention in that the outer frame is provided with at least two openings, in each of which openings an elastic element can be positioned from outside, said opening and said elastic element being provided with means for effecting a detachable connection therebetween.

During assembly or upon replacement of an elastic element, the element to be assembled can be positioned in the opening from outside and, using the aforesaid means, be fixed in a radial position, seen from above, between the inner frame and the outer frame in such a manner that the inner frame with the clockwork is connected to the outer frame. The elastic elements, which are preferably made of natural or synthetic rubber, ensure that the external axial and radial forces exerted on the outer frame forming the outer side of the watch will be minimal on the inner frame with the clockwork.

The inner frame is provided with a clockwork which is either to be connected thereto or which is made in one piece with the inner frame.

The elastic elements are compressible in radial direction or, in other words, the longitudinal direction of the elastic elements, for absorbing the radial forces. Furthermore, the elastic elements are compressible in all the other directions, among which the axial direction, for absorbing the forces acting on the watch.

A special preferred embodiment of the watch according to the present invention is characterised in that said means comprise screw thread on an inner wall of the opening of the outer frame, as well as screw thread on the elastic elements.

The elastic elements can be firmly secured in the opening of the outer frame by means of said screw thread, and by screwing the elastic elements far enough into the outer frame, the inner frame can be fixed in position in the outer frame as a result of being clamped between, for example, two or more spaced-apart elastic elements.

Furthermore, the elasticity of the elastic elements can be adjusted by means of said screw thread. By screwing an elastic element connecting the inner frame to the outer frame further into the opening in the outer frame, the elastic element itself is compressed in radial direction. Such adjustable elasticity can be used for setting different elasticity positions of the elastic elements. A first position of the elastic element corresponding to a first predetermined elasticity may for example be suitable for normal use, whilst a second position corresponding to a second predetermined elasticity makes the watch suitable for practising sport.

Securing the elastic elements in the opening or adjusting the elasticity of the elastic element can be done by means of a screwdriver. Fitting and/or replacing an elastic element can thus be done by means of comparatively inexpensive tools.

In the case of an elastic element which can be adjusted by means of a screwdriver, a covering element may be provided in or over the opening in the outer frame, if desired, after the elastic element has been adjusted/fitted.

It is also possible, however, to configure the elastic elements so that they are connected to a part extending outside the outer frame, which part extends outwards in any position of the elastic element. By rotating said part, the elastic element is screwed further or less far into the opening, so that the elasticity and/or the screw depth can be adjusted by the user himself or herself. Furthermore, predetermined positions as discussed above can be provided for the user. In such an embodiment, a safety arrangement defining an adjusting range is provided, so that the user cannot unscrew the elastic element so far that the elastic element loses contact with the inner frame, or screw the elastic element down too far, so that the elastic element will become too rigid and insufficiently capable of absorbing the forces that act on the watch for protecting the clockwork.

Instead of using screw thread, a snap mechanism may be formed by the aforesaid means of the opening and the elastic element. By inserting the elastic element into the opening and exerting an additional force thereon, for example, the elastic element is snapped in position in the opening, in such a manner that the inner frame is clamped down by means of two or more elastic elements, for example.

A special preferred embodiment of the watch according to the invention is characterised in that a floating suspension of the inner frame with the clockwork in the outer frame is realised by means of the elastic elements.

Floating suspension of the inner frame provided with the clockwork implies that an annular air gap is present between the inner frame and the outer frame, but also that the inner frame provided with the clockwork does not make contact with the bottom and/or the upper side of the watch, which may or may not form part of the outer frame. By using such an inner frame suspended by means of the elastic elements, the forces are absorbed not only as a result of compression of the elastic element, but also as a result of the fact that the elastic elements are so flexible that when a force is exerted on the outer frame, the inner frame provided with the clockwork will be maintained in a substantially fixed position, with the elastic elements being set so that the movement of the inner frame will not at any time be larger than the gap distance between the inner frame and the outer frame.

Another preferred embodiment of the invention is characterised in that the watch is provided with three elastic elements, which are spaced so far apart that said elements are arranged in a triangular configuration.

Such a configuration appears to confer maximum protection of the clockwork against the extreme forces while using a minimum amount of elastic elements.

Figure 1B:
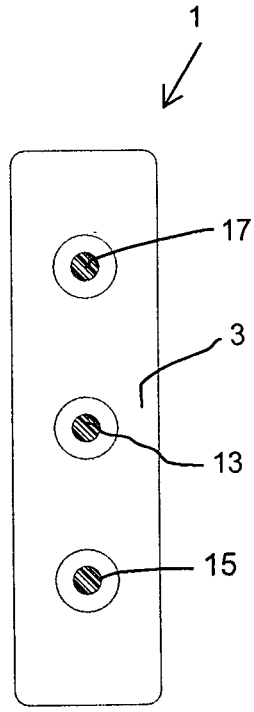
Figure 2:
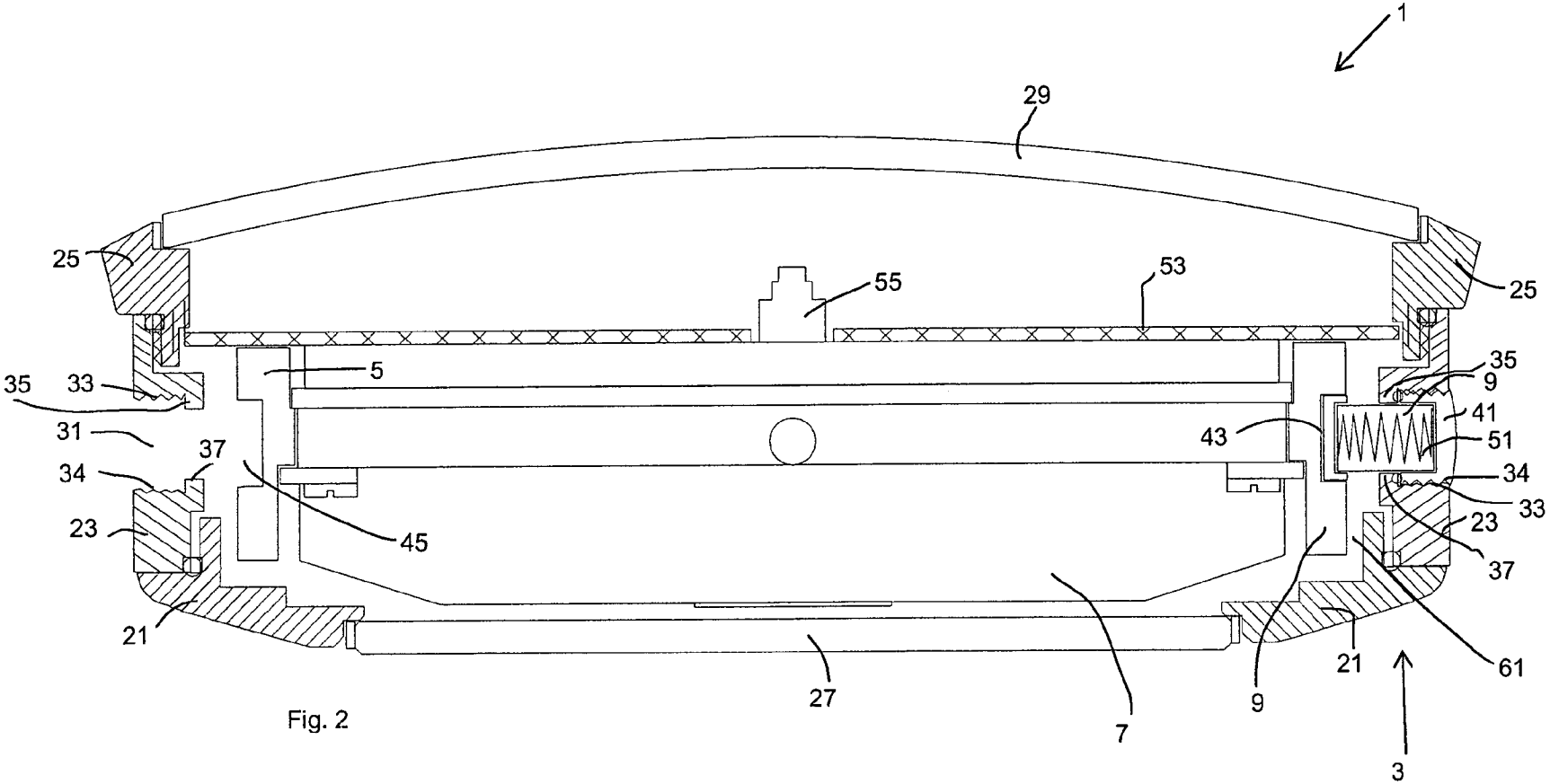

The invention will now be explained in more detail with reference to the drawings, in which:

FIGS. 1*a*-*b* show a schematic top plan view and a side view, respectively, of a watch according to the invention;

FIG. 2 shows a sectional view of a watch according to the invention.

Like parts are indicated by the same numerals in the figures.

FIGS. 1*a* and 1*b* show a schematic top plan view and a side view, respectively, of a watch 1 according to the invention. For the sake of clarity, some aspects of the watch, which are for example visible in FIG. 2, have been left out in FIG. 1*a*. The watch 1 comprises an outer frame 3 and an inner frame 5. The inner frame is connected to a clockwork 7. The clockwork 7 may be of a type that is known per se. The frames 3, 5 are connected by three substantially radially extending, spaced-apart the elastic elements 9.

In FIG. 1*a* a virtual triangle 11 is shown, which interconnects the elastic elements.

The watch 1 further comprises a winding mechanism 13 to be operated by a user, as well as two adjusting mechanisms 15, 17, by means of which a user can adjust the clockwork 7, if desired, and activate or deactivate any options of the clockwork 7 that may be provided.

The watch 1 can be strapped to a user's wrist by means of a watch band 19.

FIG. 2 shows a sectional view of the watch 1 according to the present invention. The sectional view clearly shows that the outer frame 3 is provided with three interconnected parts 21, 23, 25 forming the outer side of the watch 1. A first ring-shaped part 21 partially forms the bottom side of the watch, to which first part 21 a bottom part 27 is connected. Said bottom part 27 may be made of transparent glass and/or a transparent plastic. The third ring-shaped part 25 is connected to the transparent upper part 29 made of plastic or glass. In combination with the third part 25, the upper part 29 forms the upper side of the watch 1. A ring-shaped side edge 23 of the outer frame 3 is positioned between the first part 21 and the third part 25 of the outer frame 3.

As is shown on the left-hand side in FIG. 1, the side edge 23 is provided with three openings 31. In said openings 31, the elastic elements 9 are to be secured.

The elastic elements 9 extending in a longitudinal direction, which, when positioned in the watch 1, extend between the inner frame and the outer frame, are provided at a first end thereof with a first securing element 41 provided with screw thread for being secured in the opening 31 in the outer frame 3, whilst the opposite end, seen in longitudinal direction, is provided with a second securing element 43, which is positioned in a recess 45 formed in the inner frame 5. By means of the recess 45, in which the second securing element 43 is positioned practically without play, the elastic element 9 is secured relative to the inner frame 5. A spring 51 is integrated in the elastic element 9, which is preferably made of a vulcanised rubber. Said spring 51 is preferably made of a metal. An elastic element 9 thus configured appears to have excellent characteristics as regards protecting the watch 1 against (extreme) external shocks.

The inner wall 33 of the opening 31 is provided with screw thread 34, which cooperates with the screw thread of the first securing element 41 of the elastic element 9. The end of the opening 31 facing the centre of the watch 1 is narrowed by means of two flanges 35, 37 facing each other, against which the securing element 41 abuts in a fully screwed-down position. The flanges 35, 37 form a safety device, i.e. a stop to ensure that the elastic elements 9 cannot be screwed into the opening 31 any further. Furthermore, the flanges 35, 37 form a watertight seal, either separately or in combination with at least one sealing ring (not shown). The watch 1 according to the invention is preferably watertight.

The inner frame 5 provided with the clockwork 7 is suspended in the outer frame 3 in a floating manner by means of the elastic elements 9. The term "floating" is understood to mean that the inner frame 5 with the clockwork 7 is only connected to the outer frame 3 via the elastic elements 9.

This means that an annular gap 61 filled with air is present between the inner frame 5 and the outer frame 3. Said gap 61 provides sufficient play for the inner frame 5, so that the said frame 5 will not touch the outer frame 3. The elastic elements 9 provide an elastic suspension of the inner frame 5 relative to the outer frame 3, so that shocks to which the watch is subjected, such as axial and radial shocks, will be absorbed to protect the clockwork 7. A suspension of this kind is in particular suitable for playing golf, for example, because the external forces exerted on the clockwork upon hitting the ball when playing golf are relatively large.

The term "floating" also means that the inner frame 5 provided with the clockwork 7 does not make contact with the bottom parts 27 and/or the upper parts of the watch.

The clockwork 7 is furthermore provided with a watch face 53 and a drive mechanism 55 for the hands (not shown), among other parts. Further details of the clockwork 7 are known per se and will not be discussed in detail herein, therefore.

The advantage of the elastic elements 9 according to the invention is that they are easy to fit, remove and inspect via the opening 31 in the outer frame 3. A screwdriver (not shown) can be used for rotating the elastic element 9. According to another possibility, a fixed extension (not shown) is attached to the elastic element or can be attached thereto by a user. Said extension is located outside the outer frame 3 in any position of the elastic element 9. A user can operate the extension by rotating it and thus move the elastic element 9 or adjust the elasticity thereof to a different position, for example, such as a position for normal use and a sport position.

By rotating the elastic element 9 further towards the centre of the watch 1 or away from said centre, the elasticity of the elastic element 9 can be adjusted in that the elastic element 9 is further compressed or extended.

In principle, all materials having similar elastic properties, such as rubber, can be used for the elastic element 9.

At least two elastic elements 9 must be used for a watch 1 according to the invention in order to protect the watch 1 sufficiently against external forces. However, it is also possible to use a configuration of more than two elastic elements 9, or the illustrated preferred configuration comprising three elastic elements 9.

Instead of using screw thread, it is also possible to use a snap mechanism (not shown) for securing the elastic elements 9 in the outer frame 3. In principle, any known and suitable detachable connection can be used with the watch according to the present invention, such as an adjustable bayonet system, for example.

The invention claimed is:

1. A watch comprising an outer frame and an inner frame comprising a clockwork, which frames are connected by at least two substantially radially extending, spaced-apart elastic elements, which elastic elements absorb forces that act on the outer frame, wherein the outer frame forming the outer side of the watch is provided with at least two openings, in each of which openings an elastic element can be positioned from outside, said opening and said elastic element being provided with means for effecting a detachable connection therebetween, wherein said means comprise screw thread on an inner wall of the opening of the outer frame, as well as screw thread on the elastic elements.

2. A watch according to claim 1, wherein the elasticity of the elastic elements can be adjusted by means of screw thread.

3. A watch according to claim 1, wherein a floating suspension of the inner frame with the clockwork in the outer frame is realised by means of the elastic elements.

4. A watch according to claim 1, wherein a spring is integrated in the elastic element, which is made of a vulcanised rubber.

5. A watch according to claim 1, wherein the inner frame is provided with a recess, in which the elastic element can be secured.

6. A watch according to claim 1, wherein the watch is provided with three elastic elements, which are spaced so far apart that said elements are arranged in a triangular configuration.

7. A watch according to claim 1, wherein the elastic elements extending in a longitudinal direction are provided at one end thereof with said means for being secured to the outer frame, whilst the opposite end, seen in longitudinal direction, is provided with a securing element which can be positioned in a recess formed in the inner frame.

* * * * *